United States Patent [19]

Chung

[11] 4,271,739

[45] Jun. 9, 1981

[54] MACHINE AND METHOD FOR FORMING, FILLING, AND SEALING PACKAGES OF LAMINATED SHEET MATERIAL

[75] Inventor: Yun H. Chung, Rossford, Ohio

[73] Assignee: International Automated Machinery, Inc., Perrysburg, Ohio

[21] Appl. No.: 47,203

[22] Filed: Jun. 11, 1979

[51] Int. Cl.[3] ..... B26D 7/14; B26D 5/20; B26D 2/06

[52] U.S. Cl. ..... 83/175; 83/328

[58] Field of Search ..... 83/175, 328, 306; 53/128, 389

[56] References Cited

U.S. PATENT DOCUMENTS

| | | | |
|---|---|---|---|
| 2,612,950 | 10/1952 | Ewing | 83/175 |
| 3,128,548 | 4/1964 | Zelisko | 83/328 X |
| 3,169,430 | 2/1965 | Mallie et al. | 83/175 X |
| 3,264,920 | 8/1966 | Hallden | 83/328 X |
| 3,673,905 | 7/1972 | Kono | 83/175 |

*Primary Examiner*—Horace M. Culver

*Attorney, Agent, or Firm*—Wilson, Fraser, Barker & Clemens

[57] ABSTRACT

A method of packaging and machine capable of continuously forming an array of packages from a double web film. A first web is fed over a rotating thermoforming drum which vacuum forms a plurality of pouches for receiving a product to be packaged, and a second web, maintained under constant pressure, is progressively disposed in sealing relation to the peripheral edges of the formed pouches in the first web as the pouches approach a vertical position while the product is simultaneously introduced into the progressively formed package at a rate not exceeding the volume of the package as it is formed.

8 Claims, 7 Drawing Figures

MACHINE AND METHOD FOR FORMING, FILLING, AND SEALING PACKAGES OF LAMINATED SHEET MATERIAL

BACKGROUND OF THE INVENTION

1. Field of the Invention

The invention relates to the art of continuously forming packages from flexible sheet material.

2. Prior Art

The art of continuously forming packages from flexible sheet material includes methods and apparatus in the following general catagories: (1) wraps, (2) preformed bags, and (3) form/fill/seal pouches. In all of the above categories, the packages are formed from flexible sheet materials, such as, for example; paper, cellophane, plastic films, aluminum foil, or a combination of the above. It will be appreciated that such packages have the inherent characteristics of being light in weight; space saving; relatively low cost; adaptable to various production, distribution, and retailing techniques; and functional for various end uses and ultimate disposal.

Wraps and preformed bags are considered to be the traditional packaging methods in the present packaging industry. Wrapping involves the utilization of a sheet of flexible material such as paper, cellophane, film, foil, or a laminated film. Generally, the sheet is fed from a supply roll and folded around the product to be packaged. Traditionally, wraps have been developed for specific products in conjunction with specific types of equipment and systems. Examples of products which have been packaged with the above method include bread, candy and cigarettes.

Preformed bags are also an old and well known form of packaging which were originally made by hand to provide convenience in handling, filling, and closing. The materials used for preformed bags include paper, cellophane, polyethylene, foil, and laminates of these materials. The introduction of plastic materials to this art has assisted in sustaining its popularity because of the advances made in the technology and graphics, especially the transparency enclosing systems which may be utilized. Products such as flour, sugar, and produce have bene typically packaged with this method.

The form/fill/seal pouch type of flexible packaging is considered to be an extension of the preformed bag art. The significant difference over the preformed bag is that the form/fill/seal pouch structure may be continuously formed from supply of web material which can be filled and heat-sealed by high-speed automated machines. Thus, a single machine may readily comprise an entire and complete packaging line.

There are basically three methods employed in the form/fill/seal packaging technique. Initially, the horizontal forming method includes a horizontally fed pouch which is produced in sequential steps, leaving the top seal opened for filling with the desired product, and final sealing. Generally, this involves a rather cumbersome mechanical process resulting in rather slow production rates.

The vertical forming method utilizes a vertically fed single web formed into a tube around a mandrel wherein the abutting seam is effectively sealed. The vertically disposed pouch is filled with the desired product, and then the top is sealed at the same time as the bottom of the next adjacent pouch is formed by sealing. Typically, the vertically fed pouch has enjoyed a considerable amount of popularity and acceptance because the technology inherently took advantage of the forces of gravity as an integral part of the packaging technique.

The third type of form/fill/seal pouch technology employing the rotary method of packaging seems to incorporate the advantages of the other above-discussed techniques while obtaining other advantages. Among some of the advantages are increased production speeds, eliminating impurity migration in the final seal, and proper registration of the filled pouches during production and thereby improving subsequent handling and treating operation. The other types of packaging techniques mentioned above have been plagued with migratory seals thereby, in an attempt to overcome the problems, the packaging machines were forced to operate at production speeds well below the designed capability. Even at the lower production speeds, the migratory seals resulted causing a premature spoilage in the packaged product and destroyed the aseptic potential of the process.

SUMMARY OF THE INVENTION

It is an object of the present invention to produce a packaging machine and method for forming packages from a pair of continuous webs of flexible sheet material wherein the product is progressively introduced to a zone between the webs as the package is being formed.

Another object of the invention is to produce a packaging machine and method of forming packages from two continuous webs of flexible sheet material wherein the product is progressively introduced to a zone between facing surfaces of the webs while they are disposed in a position other than horizontal.

Another object of the invention is to produce a method and apparatus for packaging a product between two cooperating sheets of flexible material wherein the mating sealing surfaces thereof are maintained in a smooth uninterrupted state during the sealing operation.

The above, as well as other objects of the invention, may be typically achieved by a method of packaging a product which includes the steps of directing a first web of film material having a plurality of cavities formed therein along a path inclined from the horizontal; directing a second web of film material to progressively sealingly cover the cavities in the first web; and simultaneously progressively filling the cavities of the first web as the second web covers the cavities with the desired volume of product no greather than the volume of the zone defined by the cavities of the first web and sealingly covered by the second web.

BRIEF DESCRIPTION OF THE DRAWING

The above, as well as other objects of the invention will become readily apparent to one skilled in the art from reading the following detailed description of the preferred embodiment of the invention when considered in the light of the accompanying drawings, in which.

DETAILED DESCRIPTION OF PREFERRED EMBODIMENT

General Description

Figure 1:
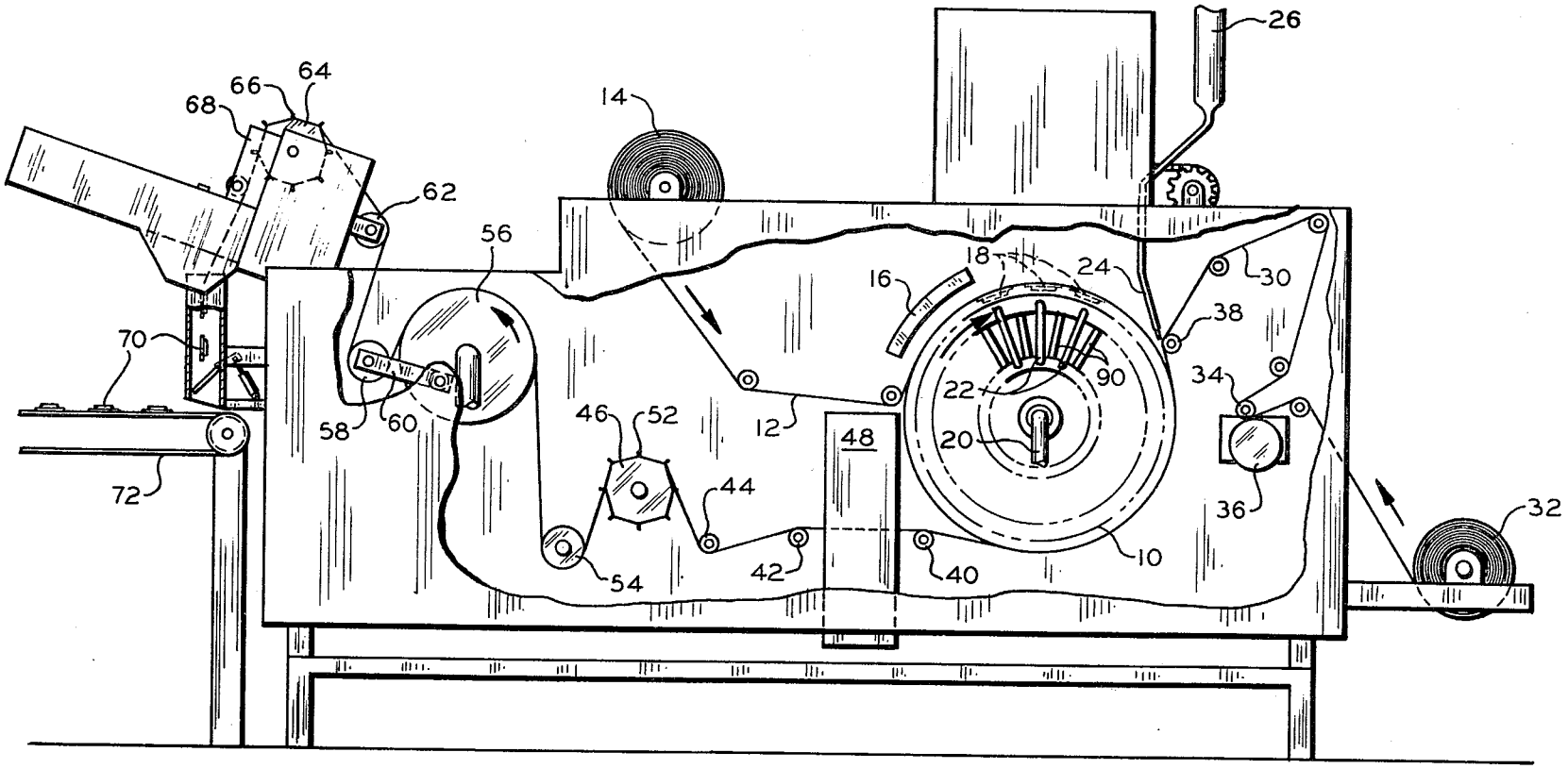
FIG. 1 is a diagrammatic elevational view of a packaging machine embodying the features of the invention with portions cut away to more clearly illustrate the structure.
Figure 2:
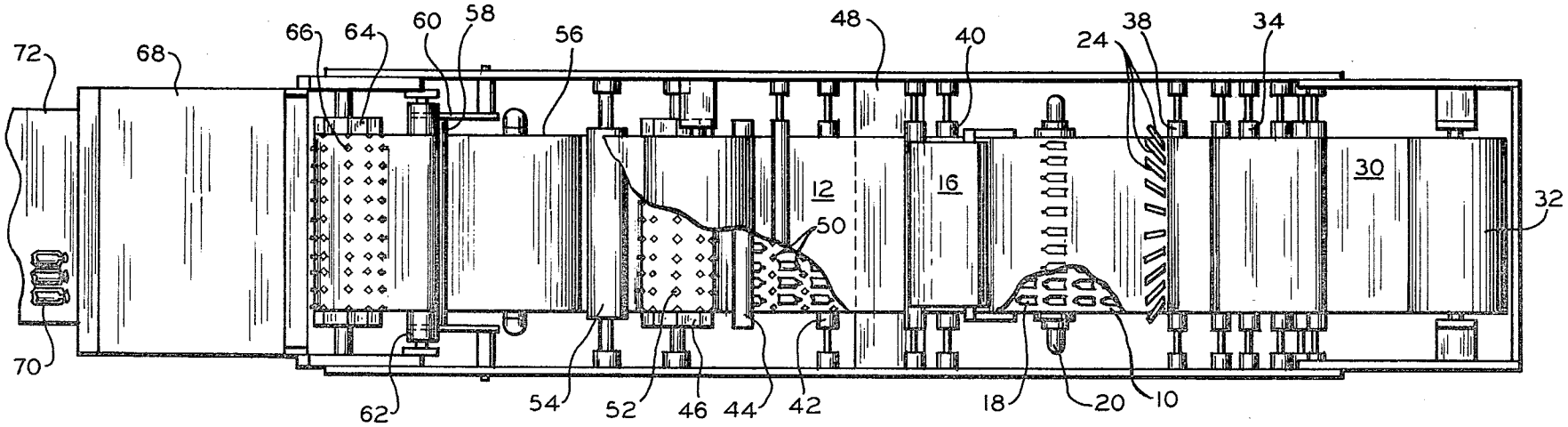
FIG. 2 is a top plan view of the machine illustrated in FIG. 1 with parts removed to more clearly illustrate the invention.
Figure 3:
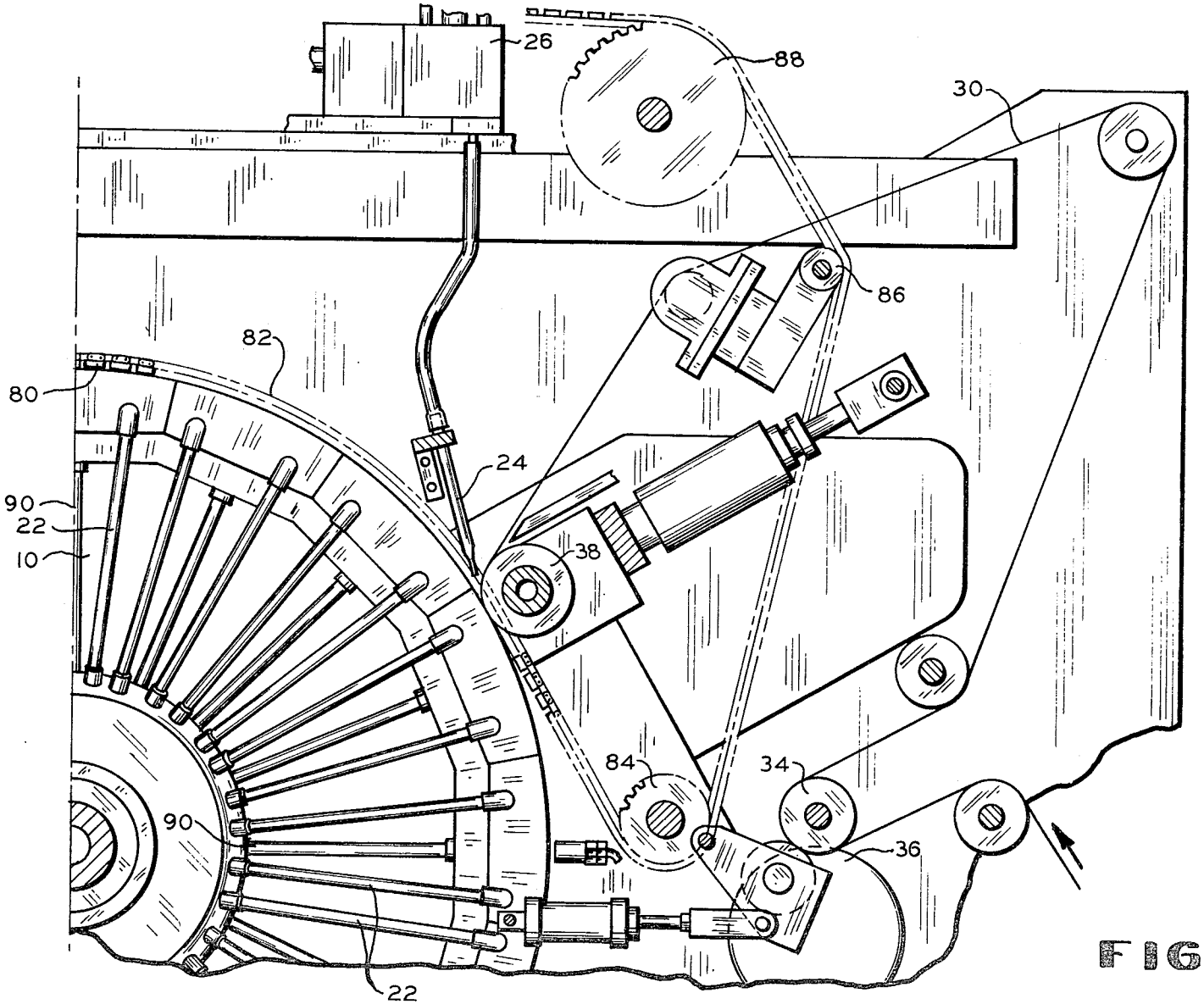
FIG. 3 is an enlarged fragmentary sectional view illustrating a portion f the rotating forming drum of the machine illustrated in FIGS. 1 and 2 showing the disposition of the filling nozzle.

To clearly and concisely understand the structure and operation of the packaging apparatus of the invention, attention is initially directed to FIGS. 1 and 2. A general description of the structure and operation of the apparatus will follow, and thence, a more detailed description will be made of the specific details of the various components.

With reference to FIGS. 1 and 2, there is illustrated a forming drum 10 driven at a constant speed in a clockwise direction to effectively draw a web 12 of a thermoplastic film from a supply roll 14. The thermoplastic film web 12 is caused to pass beneath guide rollers and, thence, a heater 16 of the radiant energy type, which functions to soften or plasticize the material of the web 12. The web 12 is then drawn, by suction, into a plurality of spaced apart forming cavities 18 formed in the outer peripheral surface of the forming drum 10. The suction, to accomplish the vacuum forming of the web 12, is applied to the cavities through a vacuum header 20. The plasticized material of the web 12 assumes the configuration of the cavities 18 and forms a pouch-like configuration for containing the product to be packaged. Typically, the formed web 12 is then cooled as it travels with the drum 10 over dead center and toward a series of filling nozzles 24 and a covering web 30. The forming drum 10 is provided with a network of internal passageways 22 for conducting a heat exchange medium, such as water, for example. The forming drum 10 may thereby be maintained at any desired temperature. Furthermore, the heat exchange medium, within the passageway 22, is effective to conduct heat energy away from the formed web 12, thereby lowering the temperature thereof causing the formed pouches to become dimensionally stable.

As the formed portions of the web 12 approach the filling nozzles 24, the covering web 30 is caused to be payed off of a supply roll 32 between a pressure roller 34 and an associated magnetic brake 36, thence, is guided by a plurality of spaced apart guide rollers, and finally over a heater roller 38. After the web 30 passes over the heater roller 38, the thermoplastic material is sufficiently plastic to seal to the flat peripheral edges defining the formed pouches of web 12. The pressure rollers 34 and the associated magnetic brake 36 cooperate to maintain the cover web 30, which may contain certain printed indicia on the outer surface thereof, in proper registration with formed cavities as it is progressively sealed to the formed web 12.

As the forming drum 10 affects movement of the formed web 12, the cover web 30 is progressively applied in sealing relation to progressively produce a covered-pouch for progressively receiving the product being packaged which is metered from a product reservoir 26 and the associated nozzles 24. It will be observed that the package being formed by the formed web 12 and the cover web 30 is vertically disposed and continuously moved downwardly away from the filling nozzles 24 so that when the metered quantity of product has been introduced into the formed package, the ends of the nozzles 24 are completely remote from the cooperating webs 12 and 30, permitting the final sealing thereof.

Then the laminated web containing the packaged product travels tangentially from the bottom of the forming drum 10 over a pair of spaced apart guide rollers 40 and 42, under a stretch roller 44 to a drive roller 46. Between the guide rollers 40 and 42 is a traveling die punch mechanism 48 which forms registering apertures 50 in the formed laminated web containing the package product.

The drive roller 46 is provided with an array of radially outwardly extending drive lugs 52 which are positioned in driving relation within the apertures 50 formed in the laminated web. The stretch roller 44 functions to apply pressure to the laminated web to assure that the die punch 48 always forms the apertures 50 in the desired location intermediate the spaced apart product filled pouches. The stretch roller 44 is effective to intermittently apply pressure to the laminated web to compensate for any changes in the overall length thereof between the tangent of the forming drum and the drive roller 46 which might be caused by changes in temperature, for example, which would cause the laminated web to expand or contract. The stretch roller 44 applies pressure to the laminated web during a period just prior to the time the cooperating die components of the die pouch 48 close until immediately after the die components are opened. The objective is to assure that at all times the product filled pouches are properly oriented with the die components of the die punch 48. The apertures 50 formed in the laminated web containing the product filled pouches are employed to enable subsequent operations to be performed on the web with great facility. For example, it may be desirable to immediately conduct the laminated web and the associated product through heating, cooling, or freezing zones and then packaged for transport or storage. However, in certain instances, it may be found desirable to store the laminated web containing the apertures 50 for later processing and shipment. In all events, the formation of the apertures 50 may make it possible to handle the laminated web and assure that the final severing of the various pouches may be achieved without severing the pouches since the orientation between the packaged product and the apertures 50 is a known factor.

FIGS. 1 and 2 illustrate a treating zone wherein the laminated web, as it is delivered from the drive roller 46, is caused to pass under a guide roller 54 over a cooling drum roller 56, and, thence, under a dancer roller 58. The dancer roller 58 is typically rotatingly supported at the outer ends of pivotal arms 60 while the other ends of the arms 60 are pivotally coupled to the side walls of the machine housing. The laminated web passes over a guide roller 62 and, thence, to an intermittently driven driver roller 64 having a plurality of spaced apart radially outwardly extending drive lugs 66. The drive lugs 66 are spaced apart in much the same manner that the drive lugs 52 of the drive roller 46 and are received in driving relation within the apertures 50 of the laminated web. Since the drive roller 64 is able to properly index the product containing pouches, the laminated web may then be fed to an intermittently actuated die cutting station 68. The die cutting station 68 includes cooperating cutting dies which intermittently open and close to sever the laminated web and produce a plurality of individual packages 70 which fall by gravity onto a conveyor 72 which transports the packages to shipping or storage containers, not shown.

When the drive roller 64 has directed or delivered the desired length of laminated web into the cutting station 68, the roller 64 stops, permitting the die cutting station 68 to operate. Since the forming drum 10 and the drive roller 46 are designed to rotate at a constant and continuous speed, the dancer roller 58 pivots downwardly to thereby maintain a constant tension on the laminated web during the time the drive roller 64 is stopped and the cutting station 68 is operating.

Forming, Filling, and Sealing Apparatus

The structure and operation of the forming drum 10, the filling nozzle 24, and a heating and sealing roller 38, are clearly illustrated in FIGS. 1 through 5. The web 12 of thermoplastic film material such as transparent polyethylene, for example, is payed off from the supply roll 14 which is rotatably mounted to the machine housing. The web 12 is guided beneath spaced apart guide rollers and thence positioned over the outer peripheral surface of the forming drum 10. The marginal edges of the web 12 are caused to be positioned snugly against and registered along the respective outer marginal edges of the forming drum 10 by two spaced apart continuous arrays of pressure pads 80 of elastomeric material, for example, mounted to depend from one surface of individual members of respective continuous articulated chains 82. While all of the supporting and driving sprockets for the chains 82 are not shown in detail, attention is directed to FIG. 3 which illustrates an idler sprocket 84, a spaced idler sprocket 86, and a drive sprocket 88 for guiding and driving the chains 82.

Figure 5:
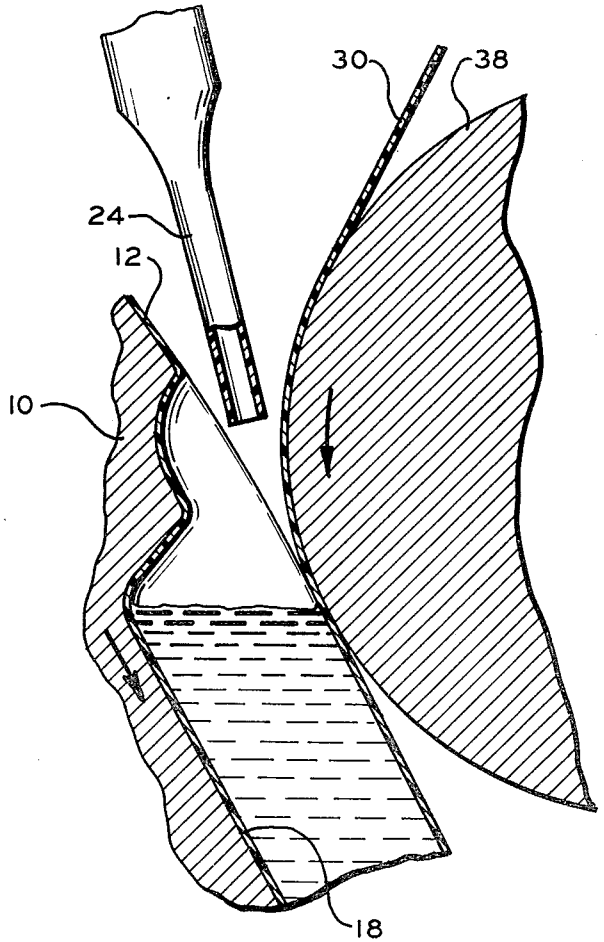
FIG. 5 is an enlarged fragmentary view similar to FIG. 4 showing the package immediately prior to being completely sealed after the entire quantity of product has been introduced therein.
Figure 4:
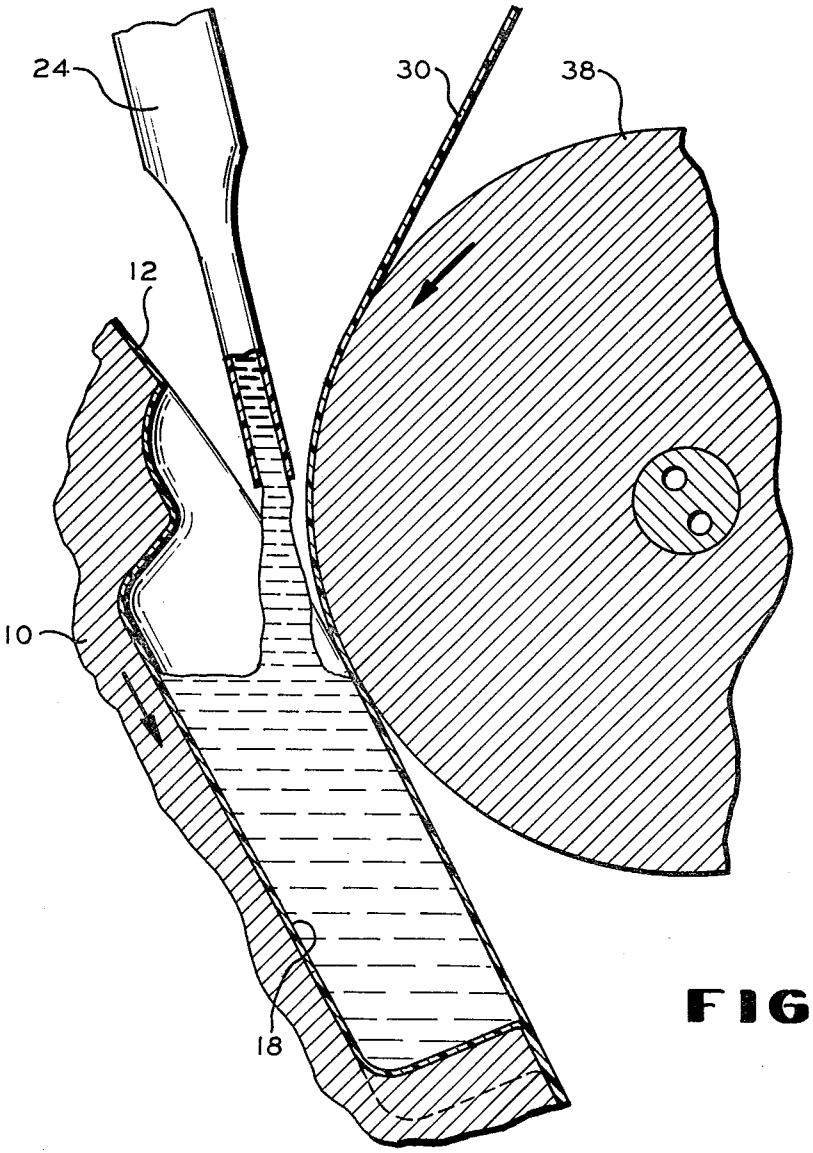
FIG. 4 is an enlarged fragmentary view in section illustrating one of the filling nozzles introducing the product to be packaged into the package being formed.

The thus positioned web 12 is driven by the forming drum 10 under the radiant heater element 16 which effectively plasticizes the material of the web allowing the same to be readily vacuum formed within the cavities 18 in the outer surface of the forming drum 10. Vacuum is applied to the various forming cavities by suitable vacuum conduits 90 diagramatically illustrated in FIGS. 1 and 3. After the web 12 has been vacuum formed within the cavities 18, the thus formed material thereof is cooled by a heat exchange medium, such as water, being circulated through the drum 10 by properly disposed cooling conduits 22. Once the material of the web 12 is cooled, the formed cavities therein become dimensionally stable and are caused to travel to a position approaching 60° offset from the top dead center position of the forming drum 10, as illustrated in FIGS. 4 and 5. It will be noted that when the formed cavities of the web 12 are in such position, the outlet ends of the filling nozzles 24 are disposed to introduce the product to be packaged within the formed cavity of the web 12. However, simultaneously the cover web 30 payed off from the supply roll 32 rotatably mounted to the machine housing is fed over a plurality of guide rollers to the heating and sealing roller 38. The material of the cover web 30 is of a thermoplastic material, such as polyethylene, for example, which when heated by the heating and sealing roller 38 becomes plasticized to a sufficient degree to seal to the flat upper and outer edges of the formed cavities of the web 12. It will be appreciated that as the cover web 30 is heated to plasticize the same and is caused to be sealed to the contacting portions of the web 12, heat energy is immediately removed therefrom to result in an air tight, hermatical, non-migratory seal. Further, it will be noted that the web 12 and the web 30 are progressively sealed together to form a package for containing the material or product delivered from the filling nozzles 24. The quantity of product to be packaged conveyed to the filling nozzles 24 from the pump reservoir 26 is delivered in a metered quantity never exceeding the volume of that portion of the package being progressively formed by the progressive sealing of the cover web 30 to the formed web 12 as the two webs are fed at the same speed. When the formed web 12 and the cover web 30 are in the relative position illustrated in FIG. 5, the metered quantity of the product to be packaged from the filling nozzle 24 is ceased and the final sealing of the formed cavity is accomplished resulting in a laminated web containing spaced apart packaged pouches of the product.

Laminated Web Registration Apparatus

Figure 6:
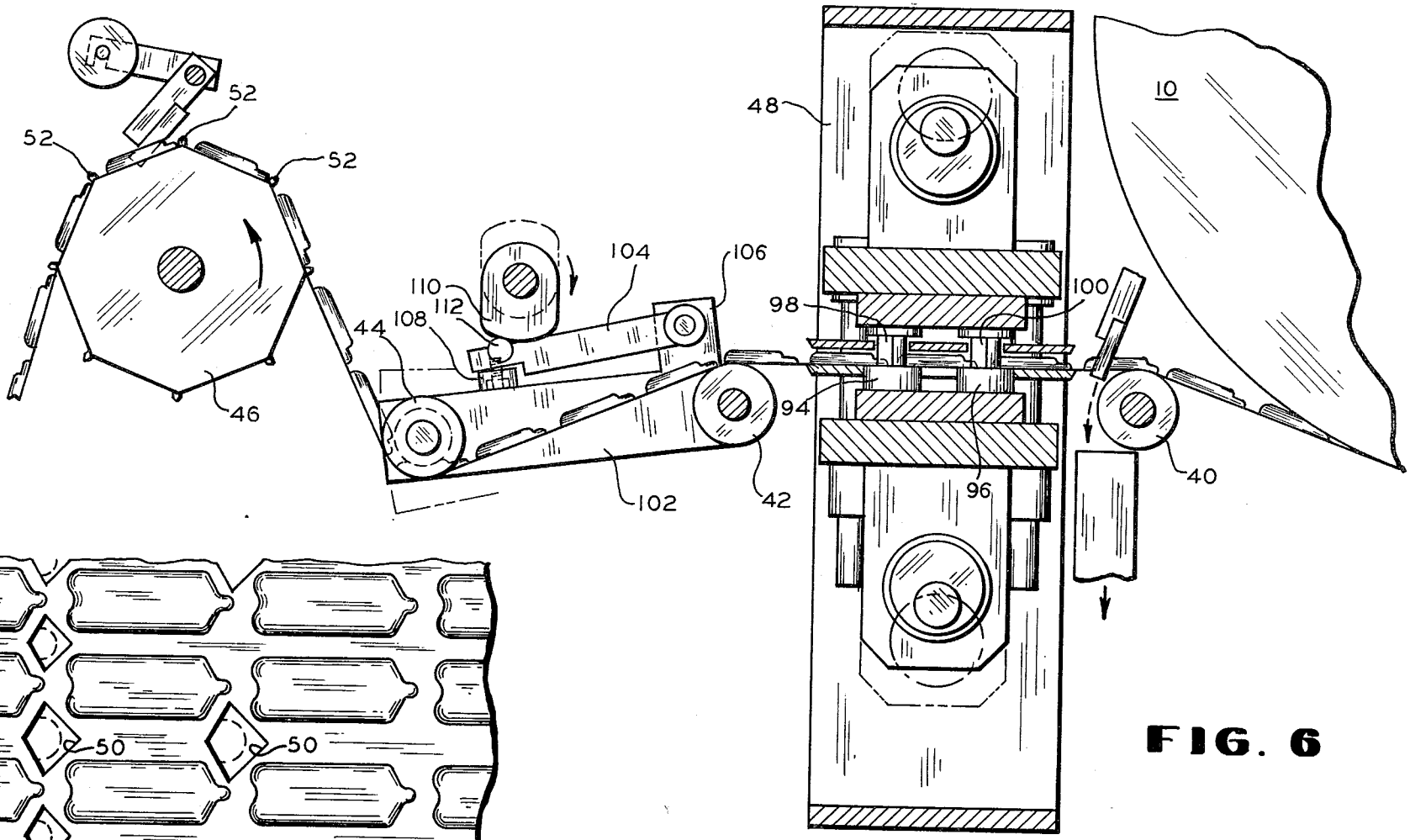
FIG. 6 is an enlarged elevational view illustrating the traveling punching die system for forming indexing apertures in the packaging web containing spaced apart package portions.
Figure 7:
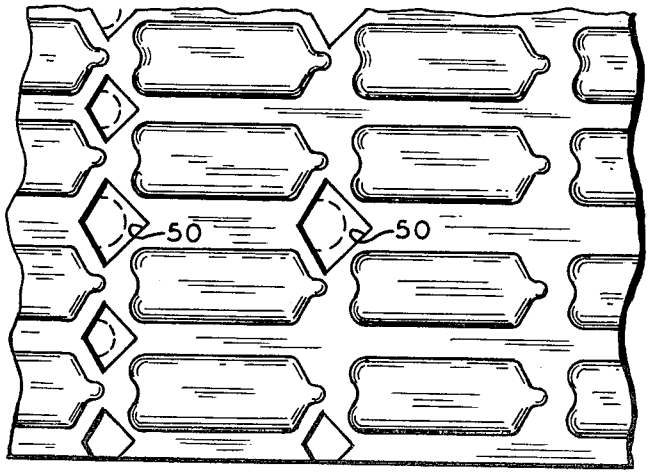
FIG. 7 is a fragmentary top plan view of the packaging web after the cooperating dies of FIG. 6 have formed indexing apertures therein.

The laminated web is thence caused to travel to a position where it is payed off from the forming drum 10, over the pair of spaced apart guide rollers 40 and 42, under the stretch roller 44, and to the drive roller 46, as clearly illustrated in FIG. 6.

The die punch 48 for intermittently punching registering apertures is disposed between the guide rollers 40 and 42, and is intermittently operated to close and simultaneously form the desired diamond shaped registering aperture and travel along at the speed of travel of the laminated web, open and thence are returned to the initial position. This operation is continued on a cycling basis during the operation of the machine. It will be noted from an examination of FIG. 6 that the die punch 48 includes two spaced apart arrays of female die elements 94 and 96, and two cooperating spaced apart arrays of male die members 98 and 100, respectively. During the time period just prior to the time that the die elements 94, 96 and 98, 100 of the die punch 48 are caused to close, the stretch roller 44 is caused to be pivoted downwardly to apply pressure to the laminated web. Such pressure is maintained until just after the die elements open subsequent to the punching operation. The strecth roller 44 is rotatably mounted at one end of a linkage arm 102 which is pivoted to rotate concentrically about the axis of the guide roller 42. The linkage arm 102 carries a pivotally mounted linkage arm 104 pivotally engaged to a block 106 mounted to one end of the arm 102, while the other end of the arm is affixed to the linkage arm 104 by a threadably adjustable linkage 108. The linkage arm 102 is pivoted downwardly by a rotating cam member 110 which is synchronized with the operation of the die punch 48. The rotating cam 110 is effective to urge the pivotal arm 104 and the linkage 102 downwardly through the connection 108 just prior to the time the die members 94, 96, 98 and 100 close and maintain such pressure until such time as just after the die members open. The pressure exerted by the stretch roller 44 is sufficient to always maintain the desired registry between the die components and the filled pouches of the laminated web even though the ambient temperature may vary causing some changes in the overall length of the laminated web between the point which it is payed off from the forming drum 10 and the drive roller 46.

As the cam 110 engages the cam follower 112 carrying the stretch roller 44 to pivot downwardly to a fixed position forcing the laminated web to stretch to assume a constant length from the tangential point of the forming drum 10 to the primary drive lugs 52 of the drive roller 46. This distance must be greater than the maximum anticipated free length of the laminated web. It will be understood that the free length of the laminated web is dependant on the material employed in the webs 12 and 30, the ambient temperature, temperature and weight of the packaged product.

The laminated web containing the registering apertures 50 is then positioned over the drive roller 46 whereupon the drive lugs 52 thereof are received within the indexing apertures 50 to effect the desired driving relationship therebetween.

After the laminated web, containing the pouches of packaged material, leaves the driving roller 46, it is caused to pass onto the treating station as explained earlier in the general description of the invention.

In accordance with the provisions of the patent statutes, the principle and mode of operation of the invention have been explained in its preferred embodiment. However, it must be understood that the invention can be practiced otherwise than as specifically illustrated and described without departing from its spirit or scope.

What is claimed is:

1. Apparatus for forming packages of product between facing surfaces of two webs of packaging material including: means for directing a laminated web of packaging material containing spaced apart sealed cavities containing the packaged product along a path;

means for sequentially forming registering apertures in said laminated web along the length thereof in spaced relation from the cavities containing the packaged product; and means for stretching (said laminated web) a portion of the length of said web including at least one of said cavities at least just prior to and just after the forming of the registering apertures, to maintain a constant length of that portion of said web in which the registering apertures are formed.

2. The invention defined in claim 1 wherein said means for stretching said laminated web is intermittently operated.

3. The invention defined in claim 1 wherein the means for directing the laminated web includes roller means.

4. The invention defined in claim 3 wherein the means for stretching the laminated web includes roller means, to a fixed position to apply pressure against the web.

5. The invention defined in claim 1 wherein the means for sequentially forming registering apertures includes an intermittently actuated cooperating cutting die.

6. The invention defined in claim 2 wherein the means for intermittently stretching the laminated web is operated in synchronism with the actuation of said cutting dies.

7. The invention defined in claim 1 including a drive means for the laminated web.

8. The invention defined in claim 7 wherein said drive means includes a drive roller having radially extending drive lugs receivable within the registering apertures.

* * * * *